United States Patent [19]

Muller

[11] Patent Number: 4,608,923

[45] Date of Patent: Sep. 2, 1986

[54] POSTAL METER VALUE SELECTOR SEQUENCING SYSTEM

[75] Inventor: Arno Muller, Westport, Conn.

[73] Assignee: Pitney Bowes Inc., Stamford, Conn.

[21] Appl. No.: 657,702

[22] Filed: Oct. 4, 1984

[51] Int. Cl.[4] ..... B41L 47/46

[52] U.S. Cl. ..... 101/91; 101/110

[58] Field of Search ..... 101/91, 99, 106, 110, 101/111; 74/352, 353, 422, 665 Q

[56] References Cited

U.S. PATENT DOCUMENTS

| | | | |
|---|---|---|---|
| 2,187,456 | 1/1940 | Komusin | 101/91 X |
| 3,573,589 | 4/1971 | Berry | 101/91 X |
| 3,882,773 | 5/1975 | Cook et al. | 101/110 |
| 4,050,374 | 9/1977 | Chelk, Jr. | 101/91 |
| 4,367,676 | 1/1983 | Clark | 101/91 |
| 4,485,735 | 12/1984 | Jonca | 101/110 X |

*Primary Examiner*—Edgar S. Burr
*Assistant Examiner*—John A. Weresh
*Attorney, Agent, or Firm*—David E. Pitchenik; Albert W. Scribner; William D. Soltow, Jr.

[57] ABSTRACT

A postage meter has a print drum with print wheels which are shiftable to select the value of the postage. The print wheels are adjusted by displacing respective transmission members; e.g. gears, which are driven by a pinion which is shifted from gear to gear. Control means is provided for controlling the shifting of the pinion so that it is engaged during each value setting only with those gears whose print wheel requires adjustment from its previous setting.

7 Claims, 5 Drawing Figures

POSTAL METER VALUE SELECTOR SEQUENCING SYSTEM

BACKGROUND OF THE INVENTION

This invention relates generally to postage meters and is concerned more particularly, but not exclusively, with rotary print drum-type postal meters including the printing mechanisms and the value setting mechanisms thereof.

Postage meters are devices for dispensing value in the form of postage printed on a mailpiece such as an envelope. The term postage meter also includes other similar meters such as parcel post meters. Meters of this type print and account for postage stored in the meter. Mechanisms are provided in the meter to set a particular value of postage to be printed on a mailpiece.

Postage meters in use today typically include a set of four adjacent print wheels, each of which carries print element characters zero through nine. The print wheels can be independently positioned to allow a user to set any amount of postage between $00.00 (for test purposes) and $99.99.

The print wheels of postage meters have in the past generally been manually set by a user through a series of mechanical linkages and levers. Setting the print wheels manually is no problem for users who process relatively little mail on a daily basis. However, for higher volume users, the meter mechanisms have been adapted for automated operation in recent times.

Postage meters have also been developed with electronic accounting systems which has led to the development of printing mechanisms and value setting mechanisms which cooperate with the electronic circuits in a manner to enhance the capabilities of the postage meter. U.S. Pat. No. 3,978,457 to Check et al, filed Dec. 23, 1974, describes an electronic postage meter in which the printing and value setting mechanisms are electronically controlled. Each print wheel is set to position a different postage amount by an independently rotatable gear mechanism. The gear mechanisms are engaged by a master gear one at a time, the master gear being rotatably mounted within a laterally movable carriage. The carriage can be moved to cause the master gear to engage in turn with the gear mechanisms. The carriage is positioned by a pair of solenoids acting through a variable linkage and the master gear is driven by a stepper motor. The print drum is driven by a separate motor. An electronic control system is fully described for operating the value setting and printing mechanisms in correct sequence in accordance with values selected by inputting a keyboard. It will also be noted that the meter may be detachably mounted on a base containing certain mechanical drives although the drives for the setting mechanism are contained in the meter itself.

U.S. Pat. No. 4,050,374 to Check, filed June 21, 1976, describes a setting mechanism for a postage meter similar to that employed in the meter of earlier U.S. Pat. No. 3,978,457 aforesaid in which the solenoids for positioning the master gear carriage are replaced by a stepper motor. It also describes a mechanism for locking the print drum against rotation during value setting. Further aspects and alternatives to the setting mechanism of such postal meter systems are disclosed in U.S. Pat. Nos. 3,965,815 and 3,977,320 to Lupkis et al.

U.S. Pat. No. 4,287,825 to Eckert, Jr. et al, filed Oct. 30, 1979, discloses a setting mechanism like that in U.S. Pat. No. 4,050,374 referred to above with a modified locking mechanism for the print drum during value selection.

U.S. Pat. No. 4,367,676 to Clark, filed May 22, 1981, describes a different approach to value setting. Here a bank of value setting gears equal to the number of print wheels are drivingly connected to respective print wheels one at a time to set the print wheels. A pinion rotated by a stepper motor is shifted from setting gear to setting gear by a tracking mechanism driven by a separate motor which also rotates the print drum at the same time. U.S. Pat. No. 4,140,055 to Lallemand, filed June 6, 1977, discloses a print wheel value changing system using a planet-wheel transmission device in which an eccentrically mounted pinion meshes with a ring gear within a postage printing drum which supports a postage printing wheel.

U.S. Pat. Nos. 4,301,507 and 4,287,825 are also of interest; the former patent describing in detail an electronic control system for use in an electronic postage meter and the latter patent describing the mechanical aspects of the meter. Pending U.S. Application Ser. No. 447,815, entitled "Stand-Alone Electronic Mailing Machine" by D. Buan and A. Eckert, filed on Dec. 8, 1982, assigned to the same assignee as the instant application, discloses further details of electronic control systems, as well as the mechanical aspects, suitable for postage meters and specifically describes a flat bed-type of printer.

Also of interest in this area are U.S. Pat. Nos. 3,965,815 and 3,977,320 which relate to electromechanical setting mechanisms for rotary drum postal meters. Other patents of general interest include U.S. Pat. Nos. 3,876,870; 3,890,491; 3,892,355; 3,918,361 and 3,949,203 issued to Malavazos et al.

The present invention embodies various improvements to postage meters generally and particularly to the printing mechanisms therefor. A novel system is disclosed for the setting of the postage value amounts in postage meters and for driving and operating the meter. The system includes, inter alia, a novel approach to moving the gear means which control the value selection for printing on the mailpiece by the postal meters, particularly a system of the type wherein the gearing is located about a single drive shaft and contained within the printing drum.

Different aspects of the invention as set forth herein variously include several advantages over prior art devices. The number of gear setting devices and, thus, the number of print devices, is not limited by the setting mechanism. In previous systems, a relatively small number of gears, such as four setting racks, had been used to change the four digits of postage ($00.00).

Aspects of the present invention permit a larger number of setting devices and a compact, in printing drum, value setting system. Thus, in one form, if the diameter of the printing drum is made of suitable size, many more print devices can be conveniently used. This enables additional changeable information, such as date, logos, cities, etc., to be placed on the postal stamp which can be quickly and easily varied.

In addition, relatively speedy value setting is possible. Furthermore, the present invention provides good security and integrity of settings and possible, electronic control of the value selection system can be utilized. Also, no positive sequence is necessary in setting the value in the presently disclosed system. In addition, a unique home position is available which disables the print drum when selecting values. There is also a reduction in the number of parts in the system compared with prior art devices with consequent cost reduction achieved.

SUMMARY OF THE INVENTION

The invention is generally concerned with postage meters for printing selected value amounts on a print receiving surface of the kind having a support and a plurality of value print devices mounted on the support, said devices each having a plurality of value print elements and being selectively movable to align selected value print elements. Means is provided for driving said support to move selected value print elements through a print position to form an imprint on a said print receiving surface. Means is also provided for automatically setting or adjusting the value print devices to align the selected print elements in accordance with selected print values. The automatic setting or adjustment means comprises value selection means for selectively adjusting the value print devices one at a time to align selected value print elements and print device selection means for selectively associating the value selection means with respective value print devices. The support suitably comprises a rotatable print drum with the value print devices comprising print wheels which are mounted within the drum and are selectively adjustable to align selected print elements in an operative position in which they are exposed at the surface of the drum.

In previous postage meter setting systems having value selection means and print device selection means, it has been necessary to associate the value selection means with the print devices in some sort of sequence whether they all required adjustment or not. According to a novel feature of this invention, the value selection means is associated during each value setting cycle only with such print device selection means, if any, which require adjustment to set the selected value amount. To this end, the control means suitably includes means for comparing a selected value amount with the next preceding value amount to determine which of said value print devices require adjustment and associating the value selection means only with value print devices requiring adjustment in an order dependent upon said determination.

Suitably, the control means includes means for monitoring the positions of the value selection means and the print device selection means. Thus, in one embodiment of the invention, control of the value of the print devices as well as the selection of particular print device to change its value may be accomplished by the use of absolute position encoding means on the print devices and on the value to be printed by the individual print devices. This in turn allows the elimination of stops and may permit bidirectional, shortest path setting of the print devices.

In accordance with a feature of the invention, the drive means for the value selection means and the print device selection has a single motor selectively engageable with the value selection means and the print device selection means one at a time. The same motor may also be used to drive the support; e.g., the print drum.

In accordance with another feature of the invention, a single main drive gear is displaceable for selectively engaging two or more of various driven elements of the postage meter; for instance, the value selection means, the print device selection means and the support or print drum.

In one embodiment of the invention, the drive system for effecting print device selection, value selection and printing is driven from a single shaft driven by a single motor. The mechanism for print device selection, value selection and printing may be located wholly within the printing drum. The shaft has a master gear attached thereto which selectively is drivingly engageable with a drum gear and a value adjustment mechanism depending upon the position of the master gear relative thereto. A control means which may be located outside of the drum can enable the master gear to be repositioned. The same control means may also be used to lock the drum from rotation when desirable.

Further aspects of the invention are concerned with postage meters of the general kind set forth in which the value selection means comprises a plurality of preferably tooth transmission members such as gears connected to respective value print devices and means for displacing the gears (transmission members).

BRIEF DESCRIPTION OF THE DRAWINGS

In order that the invention may be more readily understood, reference will now be made to the accompanying drawings wherein.

DETAILED DESCRIPTION

Figure 1:
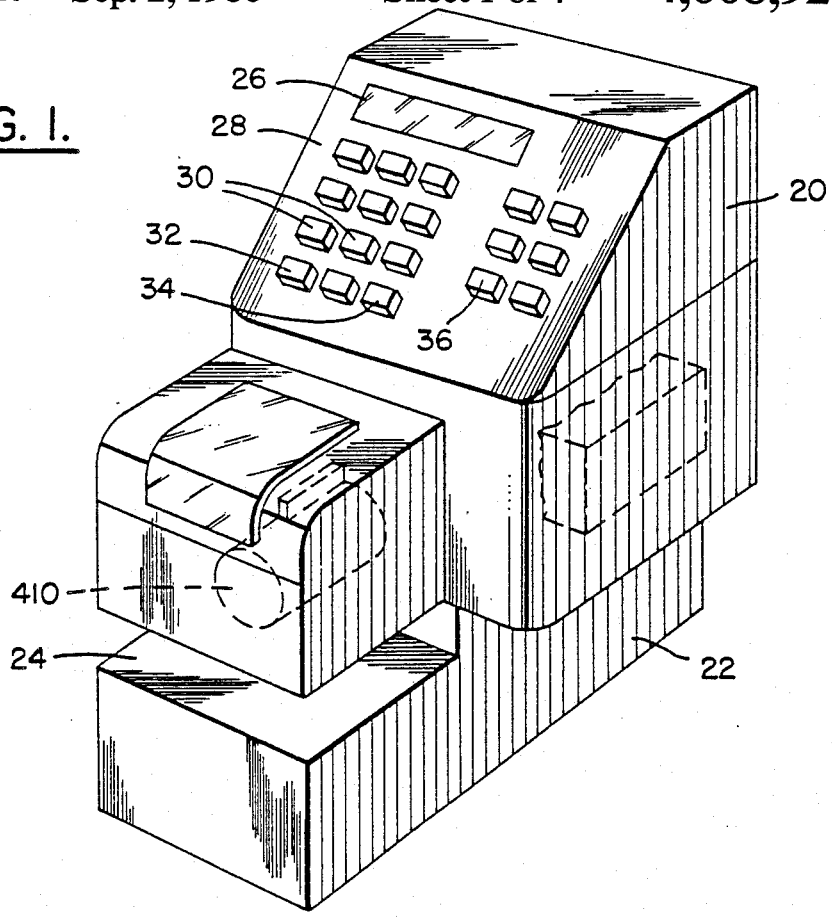
FIG. 1 is a simplified perspective view of a postage meter incorporating apparatus according to the present invention.

Referring to the drawings, particularly FIG. 1, there is shown a postage meter 20 according to the invention which can be removably fixed to a base 22. A slot 24 is provided between the meter 20 and the base 22, at the forward edge thereof, for receiving envelopes or the like and the printing of postage thereon. The postage meter is provided with a display panel 26, preferably an electronic display, as well as a control panel 28. Any suitable type of electronic control system may be used with the rotary value mechanism disclosed herein.

The meter 20 could be made removable from the base 22 in any suitable manner; for instance, in the manner disclosed in U.S. Pat. No. 2,934,009, Bach et al, which incorporates a mechanical drive for operation of the printing mechanism in the base. The separability of the meter and base, inter alia, simplifies servicing and transport of the meter for recharging.

The control panel for the postage meter can be any suitable type, such as one provided with a numeric or alphanumeric display 26. For example, a conventional multiplexed, seven-segment LED or LCD display may be used. In addition, the control panel can be provided with numeric setting keys 30 and a decimal key 32 for setting the meter to print a desired amount of postage, the amount normally being displayed on the display 26. A clear key 34 may also be provided to clear the display amount in the event, for example, of an erroneous entry. When the displayed amount has been set to the desired value, depression of a set postage key 36 effects setting of the printing mechanism. Printing may be initiated by the insertion of an envelope or the depression of a print key.

The panel may further be provided with a series of keys enabling the selective display of other values on the display 26. For example, keys may be provided for displaying the contents of an ascending register; i.e., the postage used by the meter, a descending register; i.e., the postage for which the meter is still charged, and other desired information. Further, a service switch (not shown) at the back of the meter may be operated to use the keys of the meter for diagnostic and other service functions. The meter may be adapted for remote meter resetting as discussed, for example, in U.S. Pat. No. 4,097,923. Further details of these functions are to be found, for example, in U.S. Pat. No. 4,301,507 referred to below.

Figure 3:
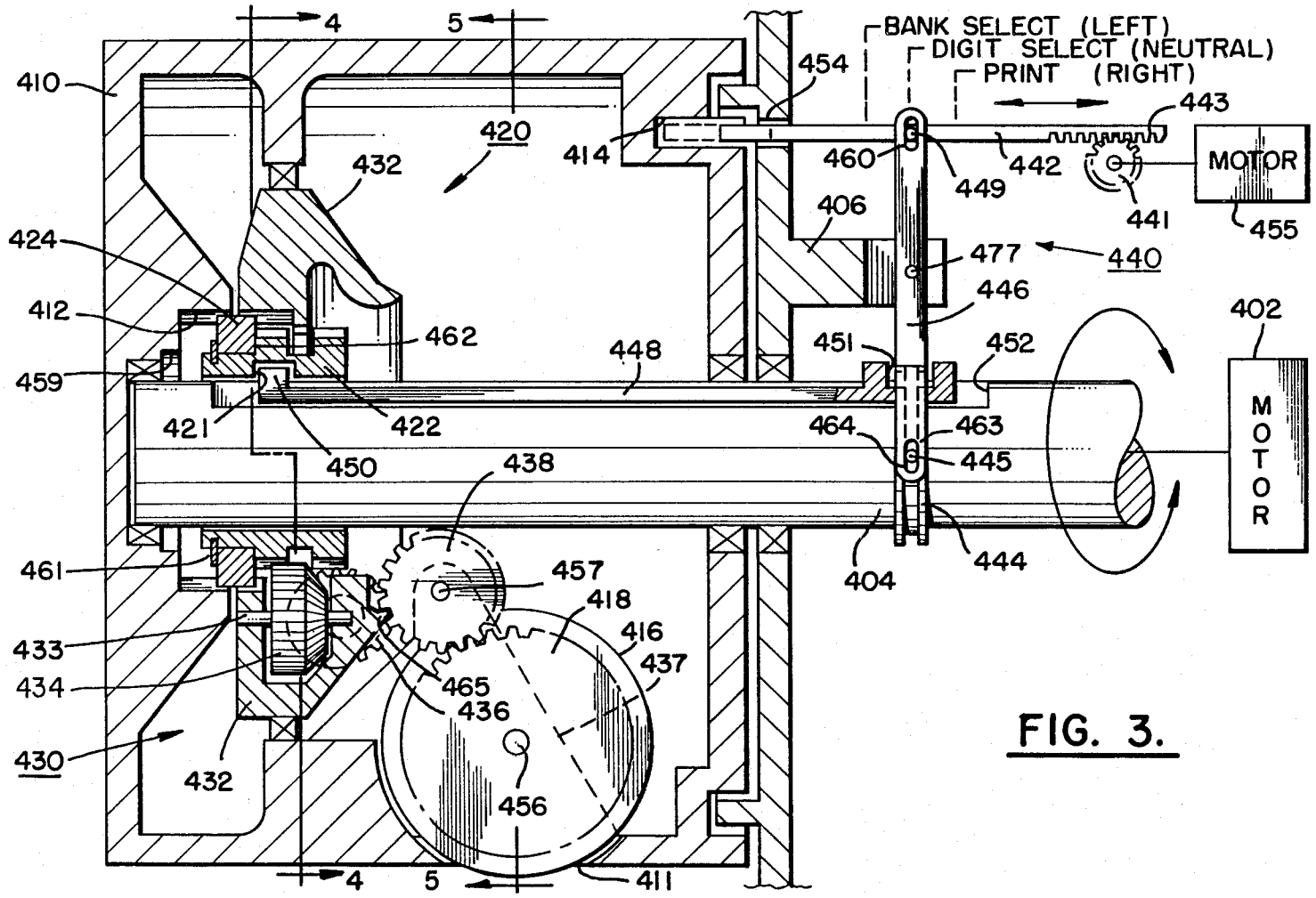
FIG. 3 is a partial cross-sectional illustration of the printing drum, value adjustment mechanism and control system for the value adjustment mechanism.
Figure 4:
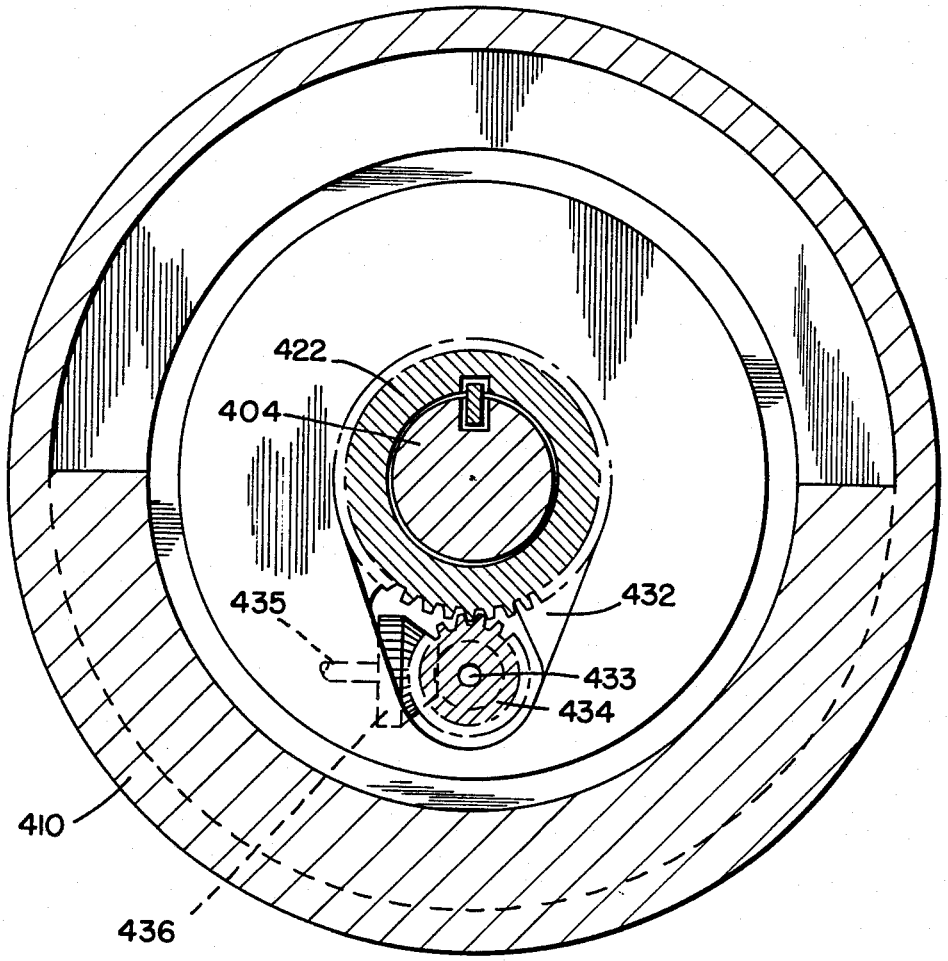
FIG. 4 is a section view of FIG. 3 taken through section 4—4.
Figure 5:
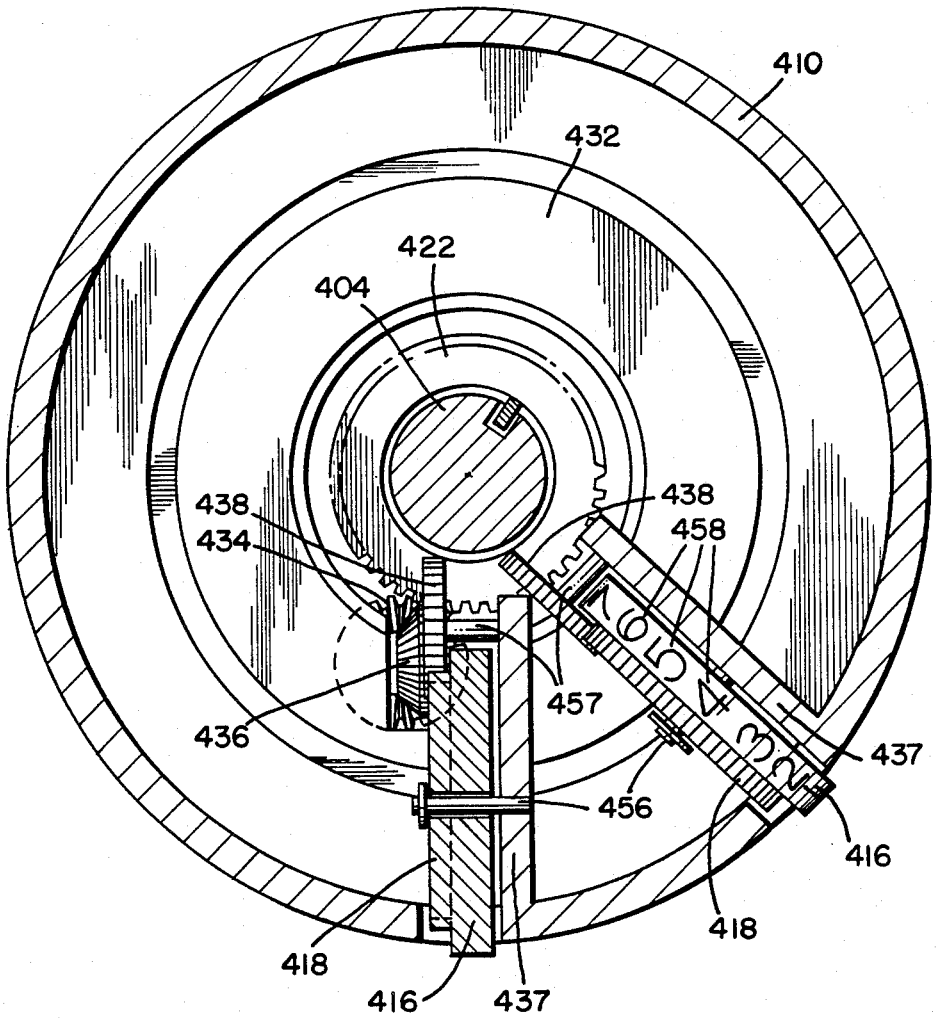
FIG. 5 is a section view of FIG. 3 taken through section 5—5.

The printing mechanism, as shown in FIGS. 3–5, includes a print drum 410 mounted in the meter 20 over the slot 24 and having an opening in its periphery 411 through which selected print elements project. For printing the selected print value on an envelope, the drum is rotated to press the print elements against the envelope which is driven through the slot 24 by frictional contact with the drum. The print elements which are suitably mounted on the peripheries of a series of print wheels 416, as shown in FIG. 5, are rotated to align the selected value print elements for printing in the opening.

Adjustment or setting of the print wheels is effected by a setting mechanism controlled in accordance with selected print values input at the keyboard 28 by means of a suitable control system such as an electronic control system. Suitable electronic control systems are described in U.S. Pat. No. 3,978,457 to Check et al and U.S. Pat. No. 4,301,507 to Soderberg et al.

The improved postage meter system incorporates drives to the printing mechanism including the setting mechanism thereof as well as the relationships of the various drives. Particular features are the selective driving of plural elements of the printing mechanism off a common main or master drive gear and the use of a single drive motor for several functions. These features will become more readily apparent from an understanding of the rotary print value selector illustrated in FIGS. 3–5, reference to which is now made.

FIG. 3 describes the components within rotatable print drum 410. Print drum 410 contains the means for selectively adjusting the value print wheels 416 to select their positions so that the appropriate print elements are in operative position to apply the proper postage to the mailpiece. This includes the value selection means for selectively adjusting the value print devices one at a time to align selected value print elements in the printing plane; a print device selection means for selectively associating the value selection means with the respective value print device; and means for driving the rotatable print drum or support for moving the selected value print elements to a printing position to form an imprint on the print receiving surface such as a mailpiece.

Contained within drum 410, in this embodiment, is adjustment system 420 which performs both value selection and print device selection. In addition, control system 440 enables the operator to manually or automatically control the mode in which the postage meter will be operated.

Adjustment system 420 includes master gear 422 and an adjustment assembly 430. It is through the combination of master gear 422, adjustment assembly 430, drum 410 and control system 440 that the three modes of operation are possible. The three modes of operation include print device or bank selection, value or digit selection and printing.

The three modes of operation, in this embodiment, are possible with the use of only one drive shaft, shaft 404, and one axially sliding, three position control system 440. In addition, the system disclosed herein has the advantage of locking the print drum in its home position while value setting occurs, locking the value print wheels when they are not being adjusted and locking the whole adjustment system when printing, or drum cycling, takes place. A single shaft, shaft 404, drives all functions of the drum and adjusts all changeable printed information such as postage amounts, data, advertising slogan, mail class, etc. In addition, the use of a single shaft with a smooth, simple, axially sliding control link allows better sealing of the meter body from the external environment thereby keeping ink, dust, and other foreign bodies from entering the meter body. This mechanism also makes it possible to position all of the movable elements of the drum with only one shaft encoder means for ease of system control.

The three modes of operation to effect drum value setting and printing are essentially carried out by selectively positioning master gear 422 which is mounted on and turns with shaft 404. The position of master gear 422 is in turn controlled by control system 440. Control system 440 acts on master gear 442 on shaft 404 through axially slidable ring 444 and select member 448. Position rod 446 is pivotally mounted on frame 406 through pin 477 so that rod 446 can move either clockwise or counterclockwise about pin 477. Shaft 404 is mounted by suitable bearings to frame 406 so the shaft can turn relative to the frame. In addition, drum 410 and shaft 404 can turn relative to one another due to suitable bearings on either end of the drum.

Shaft 404 has a channel 452 therein which carries select member 448. Select member 448 has a connecting portion 450 on one end thereof (left end in FIG. 3) and a slotted portion 451 on the other end thereof (right end in FIG. 3). As drum 404 is rotated, it carries with it channel 452 and select member 448. Select member 448 clears positioning rod 446 during such rotation due to slot 451. Connecting portion 450 of the select rod engages master gear 422 through keyway 421 in the master gear. The purpose of select rod 448 is to position master gear 422 in one of three positions relative to drum 410 and adjustment mechanism 430 to operate the system in one of the three modes of operation.

Three modes of operation are possible depending on the position of positioning rod 446. The three modes are the digit select mode (value selection) wherein rod 446 is in the neutral or vertical position; the bank select mode (print device selection) wherein rod 446 is moved in the counterclockwise direction and control rod 442 is positioned left of its neutral position; and the printing mode (print drum cycling) wherein rod 446 is moved in the clockwise direction and control rod 442 is located to the right of its neutral position. Any suitable means for moving rod 446 can be used. For instance, rod 446 can be moved to each of the three positions by the operator manually doing so. Alternatively, rod 446 can be placed in any of the three positions by any suitable automatic means such as a solenoid or motor which is automatically operated from the keyboard.

The top of positioning rod 446 is mounted onto and can pivot relative to control rod 442 through pin 449. Pin 449 moves within slot 460 of rod 446 to accommodate the rotary motion of rod 446 to the linear motion of rod 442. Control rod 442 passes freely through frame opening 454 and, depending upon its position, may engage drum lock channel 414.

Adjustment system 420 includes master gear 422 and ring gear 424. Ring gear 424 has gear teeth on its outer periphery which can mesh with drum gear 412 and select gear 432. However, ring gear 424 has a non-tooth surface on its inner periphery allowing it to be freely rotated relative to and be supported by the left hand portion of the surface of master gear 422. Teeth 412 of drum gear 410 may be made out of and be integral with the drum material. Master gear 422 has teeth on the periphery of its mid and right hand portions that are engageable and meshable with the teeth on select gear 432 and combination spur and bevel gear 434.

Select rod 448, depending upon the direction it moves, carries master gear 422 axially along shaft 404. Ring gear 424 moves axially relative to shaft 404 along with master gear 422 as it changes position. Ring gear 424 serves to lock select gear 432 to gear 412 in the digit selection or neutral position. This occurs by drum 410 being locked by rod 442 and the teeth of ring gear 424 being engaged with drum gear 412 and master gear 432. Ring gear 424 is able to stay stationary at this time due to the fact that master gear 422 can rotate relative to inner surface of the ring gear. The position of ring gear 424 is determined according to the position of master gear 422, this association being accomplished in any suitable manner such as side flanges 461 and 462 on the master gear which keep the two gears together along shaft 404.

Adjustment assembly 430 also includes select gear 432 and combination spur and bevel gear 434 which are adapted to be driven by the master gear 422. Select gear 432 and combination spur and bevel gear 434 have teeth on their internal and external surfaces, respectively, which are meshable and engageable with the master gear. Select gear 432 has a first set of teeth on its internal surface, left hand portion, that is engageable and meshable with ring gear 424. It also has a second set of teeth on its internal surface, right hand portion, that is engageable and meshable with master gear 422. Combination spur and bevel gear 434 has a conically-shaped gear portion which meshes with the conically shaped gear portion of combination spur and bevel gear 436. The motion of combination spur and bevel gear 434 is passed onto combination spur and bevel gear 436 through their respective conically-shaped surfaces.

Combination spur and bevel gear 436, as will be explained below, is selectively positionable to engage and drive one at a time each print device 416 mounted on the drum. As can be seen in FIG. 3, combination spur and bevel gear 436 is engaged with one of the print devices 416 through idler gear 438 and print device gear 418. Idler gear 438 and print device gear 418 are mounted on the drum 410 via bracket 437 and rotate about shafts 457 and 456, respectively.

Select gear 432 can be mounted on and concentrically rotated relative to drum 410 by virtue of a suitable bearing. Combination spur and bevel gear 434 is mounted on select gear 432 through shaft 433 and is allowed to turn freely on its shaft relative to select gear 432. Combination spur and bevel gear 436 is also mounted (not shown in FIG. 3) on select gear 432 so that it can be driven from master gear 422 through combination spur and bevel gear 434. The conicaly-shaped portions of combination spur and bevel gears 434 and 436 are maintained in continuous mesh during all three modes of operation.

Print device 416 can be of the type that is used in conventional rotary postal meter systems. The periphery of the device can have a plurality of value print elements 458, as shown in FIG. 5, about it, and, depending upon which element is placed in opening 411, the postage can be selected. Only one print element on the periphery of a particular print device 416 can project through opening 411, and into the vicinity of the surface of drum 410, at a time.

The term "digit select" as used herein refers to placing that digit or symbol on the periphery of an individual print device 416 that is actually in position (projects through opening 411) to print on the mailpiece. The term "bank select" as used herein refers to placing the adjustment mechanism in engagement with the particular print device 416 that is to be changed. In a typical postage meter of the type described herein, there are generally a plurality of print devices 416 that together make up the complete field of changeable information.

Figure 2:
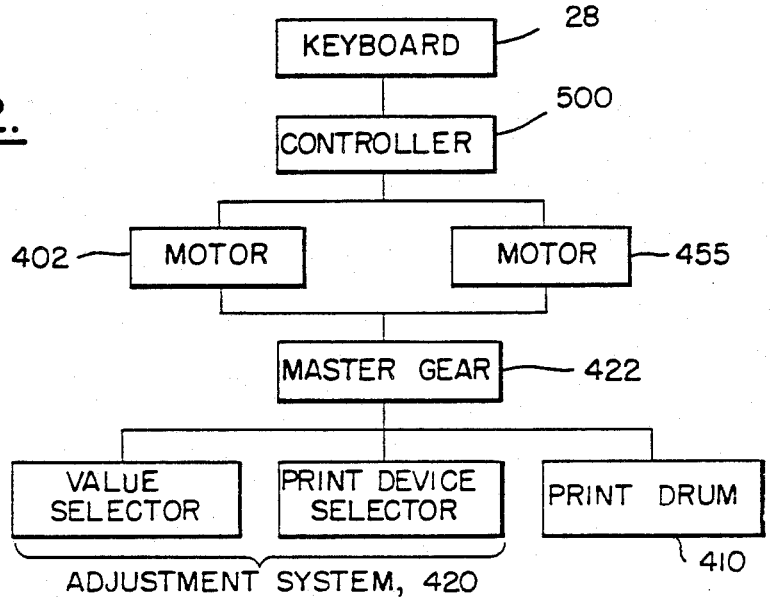
FIG. 2 is a block diagram illustrating the relationship of elements within the postage meter.

In accordance with a feature of this invention, the main drive motor for rotating the printing drum shaft, shaft 404, also drives print device selection and value selection. Motor 402, as shown in FIGS. 2 and 3, is controlled by the information that is placed into the keyboard 28 by the operator. Such control is maintained by any suitable device, as mentioned otherwise herein, such as by an electronic controller designated as 500 in FIG. 2. Controller 500, at the appropriate times, activates motor 402 to turn shaft 404. Since shaft 404 can optionally turn in either direction, a suitable motor for this purpose would be a d.c. motor.

The control system may optionally function in an automatic manner. In this case, a second motor, such as stepper motor 455, could be used to position the control rod 442 through any suitable linkage to control rod 442. For instance, the control rod could have a rack-like portion 443 which is driven by control rod gear 441 which in turn is accurately positioned by stepper motor 455.

Depending upon the position of master gear 422, shaft 404, when rotated by motor 402, can drive adjustment system 420 to set the postage value or cycle the printing drum for applying postage to the mailpiece. FIG. 3 depicts adjustment mechanism 420, print drum 410 and control system 440 when the digit select mode is intended to be operated. In this position, control rod 442 passes through frame opening 454 and engages with lock channel 414 so that the drum cannot rotate relative to frame 406. Also at this time, select member 448 positions master gear 422 to rotate print device 416 to bring the appropriate printing element 458 into opening 411 in drum 410. In this position, ring gear 424, which moves in accordance with the position of master gear 422, is in engagement with drum gear 412. At this time, ring gear 424 is also simultaneously engaging the teeth on select gear 432 and, therefore, gear 432 is prevented from rotating since drum 410 is locked in its home position. In the digit select mode, master gear 422 is engaging combination spur and bevel gear 434 which has two portions, a standard gear portion and a conical gear portion.

When shaft 404 rotates, it turns master gear 422 which is keyed to it. Master gear 422 drives combination spur and bevel gear 434 which in turn drives combination spur and bevel gear 436. It is assumed at this time that combination spur and bevel gear 436 is in engagement with one of the idler gears 438 associated with a particular print device 416. The rotation of combination spur and bevel gear 436 drives idler gear 438 and in turn print device gear 418. In this manner, print elements 458 on the periphery of print device 416 can be placed in opening 411 of drum 410 selectively.

Positioning of the print elements on print device 416 may be accomplished accurately by providing absolute encoders for each print wheel which would allow bi-directional, shortest path setting. Alternatively, stops could be provided on the print devices 416 and incremental bi-directional rotation sensing of suitable resolution on the drive shaft to control the rotation of the print devices through the controller 500. In this case, there would be need for only one encoder which would be used for computation of the position of all elements driven by the shaft.

As shaft 404 rotates carrying with it master gear 422 in the digit select mode, combination spur and bevel gear 434 drives print device 416. During this time, select gear 432 remains stationary as does drum 410. This relative movement is possible by virtue of the fact that drum 410 is locked down by control rod 442, and any relative movement between master gear 422, on the one hand, and drum gear 412 and select gear 432, on the other hand, is taken up by the sliding action between ring gear 424 and the left hand portion of master gear 422.

A description is now given for the bank select mode of the system with reference to FIGS. 3–5. Since there are a number of print devices 416 arranged adjacent opening 411, provision is made to change any of them that require adjustment. For instance, to accommodate postage up to $99.99, a system would have four print devices 416 for value, and perhaps additional such devices to change other information that is selectable such as the date, advertising slogan, mail class, etc. Thus, there can be a plurality of purposes as well as a plurality of print devices arranged in the drum which must be selected by the bank select mode.

In order to select a particular print device so that it can be adjusted to the proper information to be printed, the bank select mode of the postage system is activated. The following description also applies when one would want to place the bank select mechanism into a free wheeling, disengaged or neutral position.

Control rod 442 is moved to the left, either manually or automatically, thrusting the left end of the control rod further into the drum locking channel 414 as shown in the dotted lines thereby assuring that the drum is locked in its home position. When this occurs, select member 448 is also moved, but to the right in FIG. 3. This is because position rod 446 rotates about pin 447, which is attached to frame 406, in the counterclockwise direction. Since the slotted portion 451 of select member 448 is moved by position rod 446 and is located below pivot 447, it moves the select member 448 to the right. When this happens, ring 444 slides along shaft 404 to the right being driven in that direction by the action of position rod 446 through pin 445.

Position rod 446, at its lower end adjacent slot 451 of the select member, branches into collar portion 463 which surrounds the upper half of shaft 404. Collar portion 463 is pivoted about and attached to ring 444 by pins 445. There are two pins 445, one on either side of the shaft 404. Pins 445 ride in slots 464 to accommodate the rotary motion of collar portion 463 to the linear motion of ring 444. Select member 448 is solid below slot 451, however, the bottom of slot 451 is below the surface of shaft 404. Due to this configuration, select member 448 clears ring 444, collar 463 and rod 446 as it is rotated with shaft 404.

The teeth on the outer surface at ring gear 424 disengage from the teeth of print drum gear 412 and master gear 422 is engaged with the adjustment assembly 430. In addition, master gear 422 engages combination spur and bevel gears 434 and 436. As a result, combination spur and bevel gears 434 and 436 are locked with and become a fixed part of the adjustment assembly 430, and, more particularly, a fixed part of select gear 432.

Consequently, in the bank select mode, master gear 422 and adjustment assembly 430 including select gear 432 and combination spur and bevel gears 434 and 436 rotate as an integral assembly when drive shaft 404 rotates. Select gear 432 has a tooth profile which slides into and locks in position with idler gear 438 associated with each print device 416. Alignment member 465 on select gear 432 keeps the idler gears 438 in position for the non-conically shaped portion of combination spur and bevel gear 436 to easily slide into and engage therewith during bank selection. Thus, the alignment member of select gear 432 locks in position idler gears 438 except for the one being reset by the adjustment assembly.

By controlling the rotation of drive shaft 404, adjustment assembly 430 is positioned so that combination spur and bevel gear 436 engages with a desired bank. Again, adjustment assembly 430 and, more particularly, the select gear 432 or some other appropriate component of the adjustment assembly, may be provided with an absolute encoder to keep track of its position relative to the banks in print drum 410. Optionally, it may be provided with a stop and the same encoder on the drive shaft used for print device positioning may be used to compute bank select assembly position.

The third mode of operation is the print mode which is not described in conjunction with FIGS. 3–5. In this mode, drum 410, already having the correct print elements selected for the postage to be applied, is rotated to apply postage onto a mailpiece. In order to place the mechanism into the print mode so that the drum 410 can cycle through a full revolution from its home position, control rod 442 moves to the right into its print position. The movement of control rod 442 to the right or print position can be subject to blockage by an interposer (not shown) controlled by the meter microprocessor directly, such interposer being removed only when all conditions for printing are met. For instance, the microprocessor could power a solenoid which would withdraw the blocking element at the appropriate time for drum cycling.

When the control rod 442 moves to the right into the print mode, the left end of control rod 442 also moves to the right and removes itself from drum lock channel 414. This frees drum 410 for rotation. Again, the movement of control rod 442 to the right provides a corresponding movement of select member 448 to the left due to the clockwise rotation of position rod 446. Select member 448 moves to the left by virtue of the interaction between its slotted portion 451 which rides with position rod 446 as it is moved in the clockwise direction. Ring 444 and pin 445 move to the left also along shaft 404. Master gear 422 and ring gear 424 are moved to the left by select member 448. In this position, master gear 422 engages drum 410 by the left hand portion of the master gear fitting into receiving cavity 459 of the drum. Adjustment assembly 430, and particularly select gear 432 and combination spur and bevel gear 434, are also directly engaged by master gear 422 at this time.

In the print mode, drum 410 and adjustment mechanism 430, including select gear 432 and combination spur and bevel gear 434, are locked together and rotate simultaneously as a unit with the rotation of shaft 404. The left end profile of master gear 422 and receiving cavity 459 of drum 410 can be configured so that engagement therebetween is allowed only when drive shaft 404 (which is keyed to master gear 422) is in its home position with respect to sensors and interlocking mechanisms in the meter body. Thus, in the print mode, shaft 404 and master gear 422 drive drum 410 through a complete revolution of the printing cycle while all the rest of the elements of adjustment assembly 430 are driven as a unit with the drum.

It is noted that in the print mode, adjustment assembly 430 is positioned in a home position in which combination spur and bevel gear 436 is not engaged with any of the gearing of any of the banks of print device 416. In bank select mode, the combination spur and bevel gear 436 is brought from the home position to those print devices 416 which are to be changed. After this has been accomplished, combination spur and bevel gear 436 is brought back to its home position where it is again positioned so as not to be engaged with any of the banks of print devices 416.

In accordance with a feature of this embodiment of the invention, adjustment assembly 430 can be contained within the drum 410 and the main motor can be housed in the base 22 of the system. Drum 410 and its internal components can be mounted in the meter 20 which can be removed from the base. It will be understood that throughout the various modes of operation, the angular position of the shaft 404, and perhaps other elements within the drum which are rotatable, and the mode of operation, as indicated by the position rod 446, can be constantly monitored by encoder discs. These discs may continuously feed signals about the movements of these elements to controller 500, the controller receiving such input in the manner described in the aforesaid U.S. Pat. No. 3,987,457.

A suitable sensor for sensing the position of the print cycle can also be connected into the controller. A suitable comparator can also be provided for comparing each new position for a print wheel with its existing position to enable the proper sequencing. While the drive motor and selector motor are preferably d.c. and stepper motors, respectively, other suitable motors or motor combinations may be used.

Sequencing of the adjustment assembly need not be accomplished in any set manner each time the postage amount is to be reset. Since the gear means, in this embodiment gear 438, is disposed in an annular array around the gear means displacement means, in this embodiment adjustment assembly 430, bank selection can occur by rotating drive shaft 404 and master gear 422 in either direction.

This is particularly useful if all of the print wheels do not have to be changed in the resetting process since the value selection means and print device selection means can be controlled such that the value selection means is ment to set the selected value amount or other changable information. The positions of the value selection means and print device selection means can be monitored and the control device can control engagement and operation of these selector means by the motor in accordance with said determinations. Thus, by sequencing the print device and value selector means, control can be carried out without stops such that the print device selector means is brought to the value print device by rotating it in the direction that takes the shortest distance or time to bring the two into operative engagement.

This invention is disclosed in the context of a postal meter, however, other types of meters and devices may have the invention applied thereto with equal value. Other such meters can include parcel service devices, tax stamp devices,, check writing devices, etc.

The detailed description herein concentrates on those aspects of the postal meter and its operation which pertain to the principal improvements over the prior art. Aspects of the postal meter system described in a more general manner may be of any well known conventional construction.

It should be understood that the above described embodiments of the invention are illustrative only and that modifications thereof may occur to those skilled in the art. Accordingly, this invention is not to be regarded as limited to the embodiments disclosed herein but is to be limited only as defined by the appended claims.

I claim:

1. A postage meter for printing selected value amounts on a print receiving surface, comprising:

a rotatable print drum, a plurality of value print devices mounted within the print drum, said devices each having a plurality of value print elements and being selectively movable to align selected value print elements, means for rotating said print drum to move said selected value print elements through a printing position to form an imprint on a said print receiving surface, value selection means for selectively adjusting said value print devices one at a time to align selected said value print elements, print device selection means for selectively associating said value selection means with respective value print devices by relative rotation, about the rotational axis of the print drum, of said print device selection means and said value print devices, means for driving said value selection means and said print device selection means, and control means for controlling said value selection means and said print device selection means in accordance with selected print values such that said value selection means is associated during each value setting cycle only with such value print devices (if any) which require adjustment to set the selected value amount such that said print device selection means is brought to said value print devices by relative rotation thereof about said rotational axis of the print drum in the direction that takes the shortest distance to bring the two into operative engagement.

2. A postage meter for printing selected value a plurality of value print wheels mounted within the print drum and each having a plurality of value print elements, said print wheels being selectively adjustable to align selected print elements in an operative position in which they are exposed at the surface of the drum, means for rotating said print drum to move the selected value print elements through a printing position to form an imprint on a said print receiving surface, value selection means comprising:

a plurality of value selection transmission members, arranged in an annular array around the rotational axis of said print drum equal in number to the number of print wheels and each associated with a different print wheel, and a pinion selectively engageable with said transmission members for displacing said transmission members one at a time to adjust said print wheels to position selected print wheels in operative position, print wheel selection means comprising an annular member rotatable about the rotational axis of said print drum and carrying said pinion for transferring said pinion moving means from transmission member to transmission member along an annular path defined by said annular array of transmission members to selectively engage said pinion with respective said transmission members, drive means for said pinion and said annular member, and control means for controlling operation of said pinion and said annular member in accordance with selected value amounts, including means for comparing a new value amount for each value print wheel with the next preceding value amount of that print wheel to determine which of said value print wheels requires adjustment and the degree of adjustment and means responsive to said determination for actuating said annular member so as to engage said pinion only with the transmission members or those print wheels that require adjustment and for actuating said pinion to adjust the transmission members engaged thereby to produce the new value amount.

3. A postage meter as defined in claim 2 which said control means actuates said annular member to engage the pinion with the transmission members in an order dependent upon said determination whereby the movement of the pinion from member to member is minimized.

4. A postage meter as defined in claim 2 in which said drive means for said value selection means and said print wheel selection means comprising a first motor selectively engageable with said pinion and said annular member for driving said annular member while said pinion is disabled and for driving said pinion while said annular member is disabled, and a second motor for effecting said selective engagement of said first motor, said control means serving to control said motors in accordance with said determination.

5. A postage meter as defined in claim 4 in which said first motor is a d.c. motor and said second motor is a stepper motor.

6. A postage meter as defined in claim 2 further including:

a main drive gear a first motor for rotating said main drive gear, and a second motor for displacing said main drive gear between a first position in which it is drivingly engaged with a first gear means for driving said pinion, a second position in which it is engaged with a second gear means for driving said annular member and a third position in which it is engaged with a third gear, means for driving said print drum, said control means serving to control operation of said first and second motors in accordance with said determination.

7. A postage meter as defined in claim 6 in which said first motor is a d.c. motor and said second motor is a stepper motor.

* * * * *